US006974363B2

(12) United States Patent
Werner et al.

(10) Patent No.: US 6,974,363 B2
(45) Date of Patent: Dec. 13, 2005

(54) UNIT FOR THE FORM MACHINING OF THE EDGES OF SPECTACLE LENSES AND METHOD OF MANIPULATING BLANK LENSES AND FINISHED LENSES IN SUCH A UNIT

(75) Inventors: Ralf Werner, Hilden (DE); Klaus Krengel, Solingen (DE)

(73) Assignee: Weco Optik GmbH (DE)

( * ) Notice: Subject to any disclaimer, the term of this patent is extended or adjusted under 35 U.S.C. 154(b) by 0 days.

(21) Appl. No.: 10/963,703

(22) Filed: Oct. 13, 2004

(65) Prior Publication Data

US 2005/0079798 A1 Apr. 14, 2005

(30) Foreign Application Priority Data

Oct. 14, 2003 (DE) ..... 103 48 456

(51) Int. Cl.[7] ..... B24B 1/00; B24B 9/00; B24B 49/00

(52) U.S. Cl. ..... 451/5; 451/42; 451/384

(58) Field of Search ..... 451/5, 8, 9, 10, 451/11, 41, 42, 43, 44, 240, 384, 390

(56) References Cited

U.S. PATENT DOCUMENTS 6,409,574 B1 * 6/2002 Shibata ..... 451/5
6,568,990 B2 * 5/2003 Siders et al. ..... 451/5
2002/0155787 A1 * 10/2002 Luderich ..... 451/5
2003/0157869 A1 8/2003 Luderich et al.

* cited by examiner

*Primary Examiner*—Jacob K. Ackun, Jr.
(74) *Attorney, Agent, or Firm*—Ostrolenk, Faber, Gerb & Soffen, LLP

(57) ABSTRACT

A unit for form machining the edges of spectacle lenses, comprising a CNC-controlled machine tool for form machining of a spectacle lens, a determining device for determining lens parameters, or for attaching a block or a sucker in a correct position and at a correct angle, a lens conveyor past the unit, a manipulator for removing blank lenses from the conveying device, for inserting a blank lens into the determining device, for removing the blank lens from the determining device, for inserting the blank lens into the machine tool, for removing a finished-machined spectacle lens from the machine tool and for returning the spectacle to the conveyor, the manipulator having a transversely movable slides, slide having a first gripper for holding a blank lens and having a second gripper, movable independently of the first gripper, for holding a finished lens in the spectacle-lens edging machine. A method of operation of the foregoing is disclosed.

4 Claims, 2 Drawing Sheets

UNIT FOR THE FORM MACHINING OF THE EDGES OF SPECTACLE LENSES AND METHOD OF MANIPULATING BLANK LENSES AND FINISHED LENSES IN SUCH A UNIT

BACKGROUND OF THE INVENTION

The invention relates to a unit for form machining of the edges of spectacle lenses. The unit has at least one CNC-controlled machine tool for form machining a spectacle lens. It has at least one device for determining the optical values, the optical center, the axial position of a cylindrical or prismatic cut, the position of a near portion and/or the position of the progression channel of a spectacle lens designed as a progressive lens. It has at least one manipulator for removing blank lenses from a conveying device, for inserting a blank lens into the device, for removing the blank lens from the device, for inserting blank lens into the machine tool, for removing a finish-machined spectacle lens from the machine tool and for returning it to the conveying device. The invention also relates to a method of manipulating blank lenses and finished lenses in such a unit.

Such a unit is described in DE 200 22 169 U1. The unit has proved successful but requires improvement regarding the sequence of the manipulating steps and the throughput rate from the insertion of a blank lens up to the output of a finished lens.

Accordingly, the problem underlying the invention is to propose a unit for form machining the edges of spectacle lenses and a method of manipulating blank lenses and finished lenses in such a unit, with which the dead time of the spectacle-lens edging machine and thus the output of finished lenses can be improved.

SUMMARY OF THE INVENTION

Based on this definition of the problem, it is proposed for a unit of the type mentioned at the beginning that the manipulator according to the invention have a transversely movable slide guided on a guide rail and have a perpendicularly movable slide in the transversely movable slide, and that the perpendicularly movable slide have a first gripper for taking hold of a blank lens and have a second gripper, movable perpendicularly on the slide, for holding a finished lens in the spectacle-lens edging machine.

The problem underlying the invention is also solved by a method of manipulating blank lenses and finished lenses in a unit for form machining the edges of spectacle lenses which method comprises the following steps:

(1) picking up a blank lens from a transport box by means of a first gripper on a manipulator, (2) inserting the blank lens by means of the first gripper into a device for determining the optical values, the optical center, the axial position of a cylindrical or prismatic cut, the position of a near portion and/or the position of the progression channel of a blank lens designed as a progressive lens, or for attaching a block or sucker to the blank lens in the correct position and at the correct angle, (3) removing the blank lens provided with a block or sucker, or not provided with a block or sucker, from the device by means of the first gripper, (4) removing an already machined finished lens from a spectacle-lens edging machine by means of a second gripper on the manipulator, (5) inserting the centered blank lens into the spectacle-lens edging machine by means of the first gripper, (6) depositing the finished lens in a transport box by means of the second gripper, (7) repeating the steps (1) to (6).

Through the use of a manipulator having a first gripper for a blank lens and a second gripper for a finished lens, it is possible to accelerate the loading and unloading operation of the spectacle-lens edging machine and to reduce the dead times occurring there, so that, overall, a shorter dwell time of the blank lens in the unit and thus a higher output of finished lenses are provided for.

Since the machining in the spectacle-lens edging machine takes up the longest time, it is important for all the manipulating steps of the blank lens to be included, as far as possible, during the machining time of the spectacle-lens edging machine in order to thereby reduce the dwell time in the unit.

Other features and advantages of the present invention will become apparent from the following description of the invention which refers to the accompanying drawings.

BRIEF DESCRIPTION OF THE DRAWINGS

The invention is explained in more detail below with reference to an exemplary embodiment shown in the drawing, in which.

DESCRIPTION OF PREFERRED EMBODIMENTS

Figure 1:
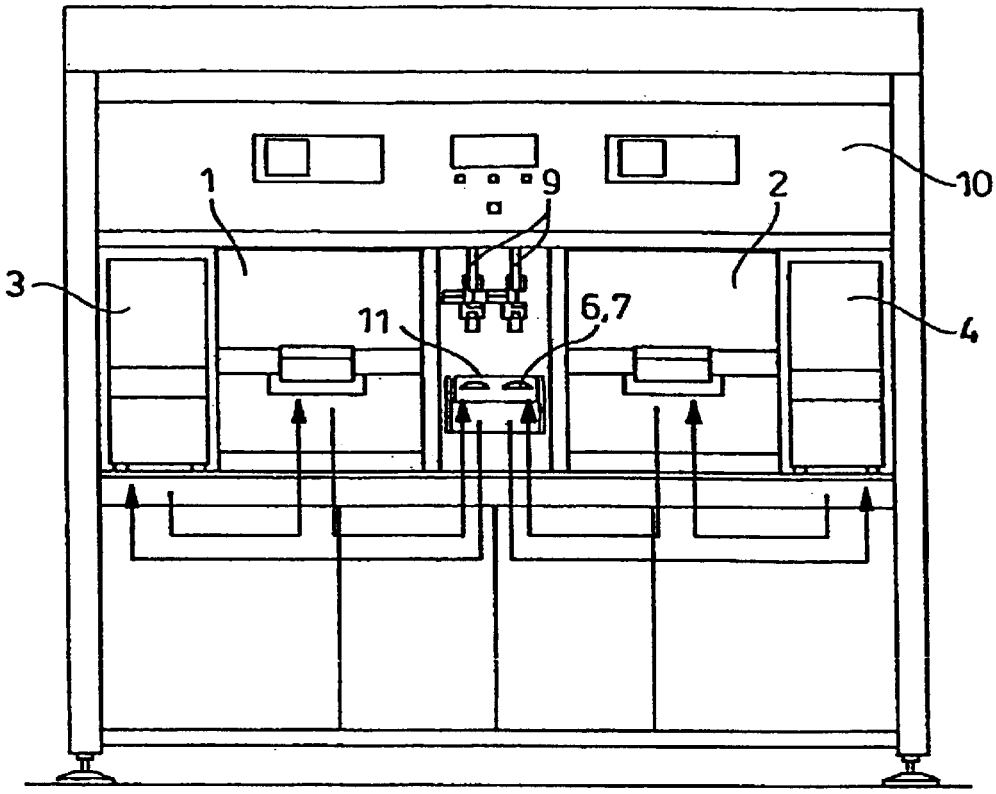
FIG. 1 shows a schematic front view of the unit.
Figure 2:
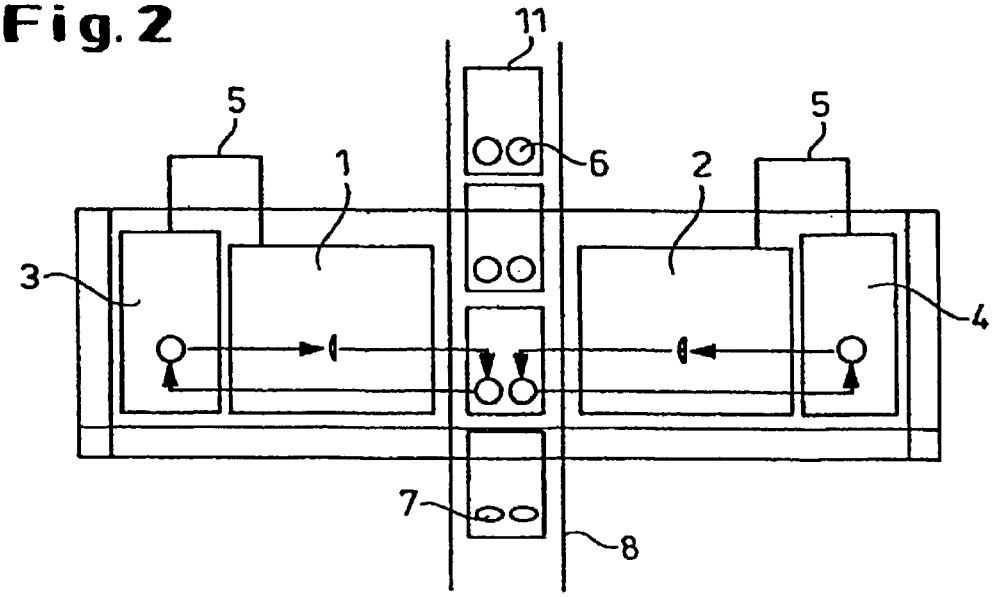
FIG. 2 shows a schematic plan view of the unit according to FIG. 1.

In the exemplary embodiment shown in FIGS. 1 and 2, a spectacle-lens edging machine 1 for a left-hand spectacle lens and a spectacle-lens edging machine 2 for a right-hand spectacle lens are arranged opposite one another, and their spectacle-lens holding shafts run coaxially to one another.

In the spectacle-lens edging machines 1, 2, spectacle-lens holding shafts, in a manner which is not shown in detail, are each arranged in machining chambers of the spectacle-lens edging machines 1 and 2, respectively. Each chamber can be closed by means of a respective hinged lid.

Diamond grinding disks (not shown) are used for the machining of spectacle lenses of silicate glass. Cooling fluid is fed to the grinding gap between a blank lens 6 to be machined, which is clamped in place between the holding shafts, and a grinding disk (not shown).

Milling cutters running at high speed or likewise grinding disks are used for the machining of plastic lenses, in which case, depending on the type of plastic, the machining is likewise effected with the feeding of a coolant or is effected dry.

A conveying device in the form of a conveyor belt 8 is arranged between the spectacle-lens edging machines 1, 2. The transport direction of the conveying device, in the exemplary embodiment shown, runs perpendicularly to the axes of the spectacle-lens holding shafts and transports blank lenses 6 arranged in transport boxes 11 and to transport finished lenses 7.

Figure 3:
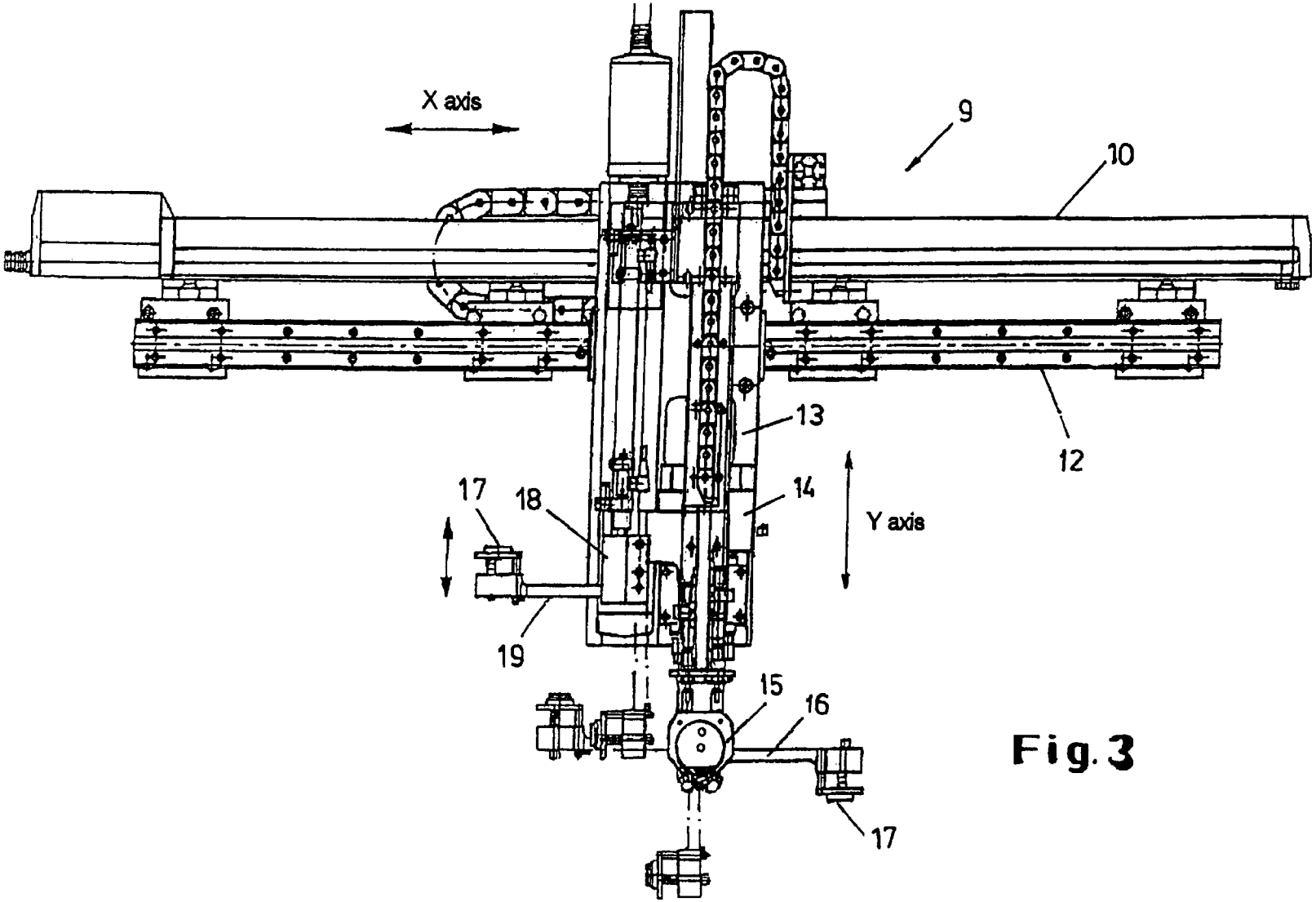
FIG. 3 shows a schematic front view of a manipulator.

The conveyor belt 8 moves each transport box 11 and comes to a stop in the region of a manipulator pair 9 movable on a portal-like guide 10. In FIG. 1, two of the manipulators of FIG. 3 are shown, one for the left lens and one for the right lens. Here, a pair of blank lenses 6 is picked up by the manipulators 9 and is inserted into devices 3, 4 for determining the optical values, the optical center, the axial position of a cylindrical or prismatic cut, the position of a near portion and/or the position of the progression channel of a blank lens 6 designed as a progressive lens. The values recorded by the devices 3, 4 are transmitted as a data volume via a data connection 5 to the spectacle-lens edging machines 1, 2. These spectacle-lens edging machines 1, 2 are CNC-controlled and are able to take into account the data determined by the devices 3, 4 during the edging of the blank lenses 6.

After the optical values, etc., have been recorded in the devices 3, 4, the manipulators 9 again take hold of the blank lenses and insert them into the spectacle-lens edging machines 1, 2, where they are form-machined into a left-hand and a right-hand spectacle lens 7, respectively.

After completion of their machining, the finished lenses 7 are removed by the manipulator pair 9 from the spectacle-lens holding shafts of the spectacle-lens edging machines 1, 2 and are replaced into the transport boxes 11. After that, the transport belt 8 is again set in motion and transports the transport boxes 11 with the finished lenses 7 into a further-processing region, where the finished lenses are inserted into the associated spectacle frame.

In the embodiment shown, the manipulators 9 have suckers 17, by which the blank lenses 6 can be held, placed between the spectacle-lens holding shafts and there clamped in position.

In this case, it is not necessary to orient the blank lenses 6 in the correct position or insert them into the spectacle-lens holding shafts at the correct angle, and the manipulators 9 only need to perform simple, constantly repeating movements, since the data recorded in the devices 3, 4 for determining the optical values, etc., and transmitted to the spectacle-lens machine tools 1, 2 contain information about the position of the blank lenses 6 which is taken into account mathematically during the spectacle-lens machining.

If the spectacle-lens machine tools 1, 2 are not CNC-controlled or do not permit a data connection to the devices 3, 4 for determining the optical values, etc., it is also possible to provide the devices 3, 4 for determining the optical values in each case with an arrangement for putting a block or sucker onto the blank lens in the correct position and at the correct angle as a function of the spectacle-lens data recorded. In this case, the manipulators 9 pick up the blank lenses 6 after blocks or suckers in the devices 3, 4 for determining the optical values, etc., have been fastened thereto and put said blank lenses 6 into the spectacle-lens holding shafts in the correct position and at the correct angle. Since the conventional blocks or suckers have receptacles which are complementary to those of the spectacle-lens holding shafts, it is sufficient if the spectacle-lens holding shafts, when coming together for clamping the blank lenses 6 provided with blocks or suckers, rotate slightly in order to latch in place in the receptacles, as a result of which the angular position of the blank lenses 6 is fixed relative to the spectacle-lens holding shafts.

The exemplary embodiment illustrated shows a twin machine arrangement for the simultaneous machining of left-hand and right-hand spectacle lenses. However, the invention is not restricted thereto, but rather also comprises embodiments having only one machine tool 1 for the form machining of spectacle lenses, one manipulator 9 and one device 3 for determining the optical values, the optical center, the axial position of a cylindrical or prismatic cut, the position of a near portion and/or the position of the progression channel of a spectacle lens designed as a progressive lens, in which case this device can either be connected to the machine tool via a data line or is provided with an arrangement for putting a block or sucker onto the blank lens in the correct position and at the correct angle as a function of the spectacle-lens data recorded, so that the manipulator can be a simple "pick-and-place robot".

A manipulator with which the method according to the invention can be carried out is shown in detail in FIG. 3.

The manipulator 9 includes a guide rail 12 fastened to a portal-like guide 10, a slide 13 which can be moved transversely on the guide rail 12 and on which a perpendicularly movable slide 14 is arranged in turn, a first gripper 15 arranged on the perpendicularly movable slide 14 and having a pivotable gripper arm 16 and a sucker 17 arranged on its end for holding a blank lens, and a second gripper 18 which is additionally perpendicularly movable on the perpendicularly movable slide 14 and has a pivotable gripper arm 19, likewise having a sucker 17 for holding a finished lens.

The grippers can be moved back and forth between the spectacle-lens edging machines 1 or 2, the device 3, 4 for determining the optical values, the optical center, the axial position of a cylindrical or prismatic cut, the position of a near portion and/or the position of the progression channel of a blank lens 6 designed as a progressive lens, or for applying a block or sucker in the correct position and at the correct angle, and the transport boxes 11.

The sequence of the method is as follows:

It is assumed that a blank lens 6 is already located in the spectacle-lens edging machine 1 or 2 for machining.

The manipulator 9 is in the meantime moved into the region of a transport box 11 in which blank lenses are located, and the first gripper 15 picks up a blank lens 6 from this transport box 11.

The manipulator 9 is then moved to the device 3 or 4 for determining the optical values, the optical center, the axial position of a cylindrical or prismatic cut, the position of a near portion and/or the position of the progression channel of a blank lens 6 designed as a progressive lens, or for applying a block or sucker in the correct position and at the correct angle, where the values of the blank lens 6 are recorded and/or a block or sucker is applied in the correct position and at the correct angle.

The blank lens 6 provided with a block or sucker, or even not provided with said block or sucker, is then removed from the device 3 or 4 by means of the first gripper 15.

The manipulator 9 is then moved into the region of the spectacle-lens edging machine 1 or 2, and an already finish-machined finished lens 7 is removed from the spectacle-lens edging machine 1, 2 by means of the second gripper 18 on the manipulator 9, and the centered blank lens 6 held by the first gripper 15 is inserted into the spectacle-lens edging machine 1 or 2 virtually at the same time, so that the edge machining of this newly inserted blank lens 6 can start immediately.

The manipulator 9 is then moved into the region of the conveyor belt 8 having the transport boxes 11 in order to deposit the finished lens 7 in a transport box 11 and pick up a further blank lens 6 from a transport box 11 by means of the first gripper 15.

The steps are then repeated in the same manner.

While a further blank lens 6 is now picked up and inserted into the device 3 or 4, the spectacle-lens edging machine 1 or 2 can already machine an inserted, centered blank lens 6, thereby achieving a significant reduction in the dead time of the spectacle-lens edging machine 1, 2.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A unit for form machining the edges of spectacle lenses, comprising:

a CNC-controlled machine tool for form machining a spectacle lens, a determining device for determining optical values, an optical center, an axial position of a cylindrical or prismatic cut, the position of a near portion and/or a position of a progression channel of a spectacle lens designed as a progressive lens, or for attaching a block or a sucker in a correct position and at a correct angle, a lens conveying device, a manipulator for removing blank lenses from the conveying device, for inserting a blank lens into the determining device, for removing the blank lens from the determining device, for inserting the blank lens into the machine tool, for removing a finished-machined spectacle lens from the machine tool and for returning the spectacle lens to the conveying device, the manipulator having a transversely movable slide, a guide rail on which the transversely movable slide is movable, a perpendicularly movable slide on and movable perpendicularly to the transversely movable slide, the perpendicularly movable slide having a first gripper for holding a blank lens and having a second gripper, also movable perpendicularly on the slide and independently of the first gripper, for holding a finished lens in the spectacle-lens edging machine.

2. Apparatus for form machining the respective edges of a pair of spectacle lenses, comprising respectively for each of the lenses, the unit for form machining of claim 1, wherein the units are arranged side by side and are independently operable from each other.

3. The unit of claim 1, wherein the lens conveying device comprises a conveyer for holding lenses to be to be removed from the conveying device and lenses returned to the conveying device, and the conveying device moving the lens past the unit and along a path accessible to the first and second grippers.

4. A method of manipulating blank lenses and finished lenses in a unit for form machining edges of spectacle lenses, the method comprising the steps:

(1) picking up a blank lens from a supply by a first gripper on a manipulator, (2) inserting the blank lens by the first gripper into a determining device for determining optical values, an optical center, an axial position of a cylindrical or prismatic cut, a position of a near portion or a position of a progression channel of a blank lens designed as a progressive lens, or for attaching a block or a sucker to the blank lens in the correct position and at the correct angle, (3) then removing the centered blank lens from the determining device by the first gripper, (4) removing an already machined finished lens from a spectacle-lens edging machine by a second gripper on the manipulator, (5) inserting the centered blank lens into the spectacle-lens edging machine by the first gripper, (6) depositing the finished lens in a in a receiver, (7) repeating the steps (1) to (6).

* * * * *